United States Patent [19]

Niems

[11] Patent Number: 4,728,287

[45] Date of Patent: Mar. 1, 1988

[54] APPARATUS FOR UNIFORMLY DRAWING AND COOLING PYROPROCESSED PARTICULATE MATERIAL

[76] Inventor: Lee H. Niems, 2702 Brassie, Flossmoor, Ill. 60422

[21] Appl. No.: 944,971

[22] Filed: Dec. 22, 1986

[51] Int. Cl.[4] ..... F27D 15/02; F27D 1/08

[52] U.S. Cl. ..... 432/69; 432/79; 432/80; 34/20

[58] Field of Search ..... 432/77–80, 432/67, 69; 34/20

[56] References Cited

U.S. PATENT DOCUMENTS

| | | | |
|---|---|---|---|
| 1,304,514 | 5/1919 | Schmatolla | 432/79 |
| 3,578,297 | 5/1971 | Niems | 432/80 |
| 4,002,422 | 1/1977 | Escott | 432/79 |
| 4,323,384 | 4/1982 | Meunier | 432/69 |
| 4,360,976 | 11/1982 | Meckel et al. | 432/79 |

*Primary Examiner*—Henry C. Yuen

[57] ABSTRACT

Apparatus for cooling a bed of pyroprocessed particulate material such as lime received from a source as a kiln, the cooler including a shaft with one or more underlying hoppers through which the material flows as cooling air is forced upwardly therethrough. Each of the hoppers has an associated air inlet assembly comprising compactly stacked air inlet rings concentric with and symmetrically shaped to the hopper entry. The air inlet rings are supplied with air from ducts which are provided with dampers by which the amount of air fed to each horizontal cross sectional segment of the hopper can be controlled. A deflector ring formed of an inclined particle flow deflector surface equalizes the rate of draw above by modifying the relative areas affected. The hoppers are each provided with a conical dispersal section having a mated frustoconical underlying section whereby material from above is first caused to flow outwardly toward the walls of the hopper and then is guided in an annular path inwardly toward the hopper exit. An exit flow regulator in the form of a suspended body of revolution associated with the bottom of the frustoconical section is adjustable in horizontal position which provides a final degree of regulation of flow from above to the exit to establish a substantially uniform temperature of the flowing mass of material throughout its cross-section.

22 Claims, 12 Drawing Figures

FIG. 5
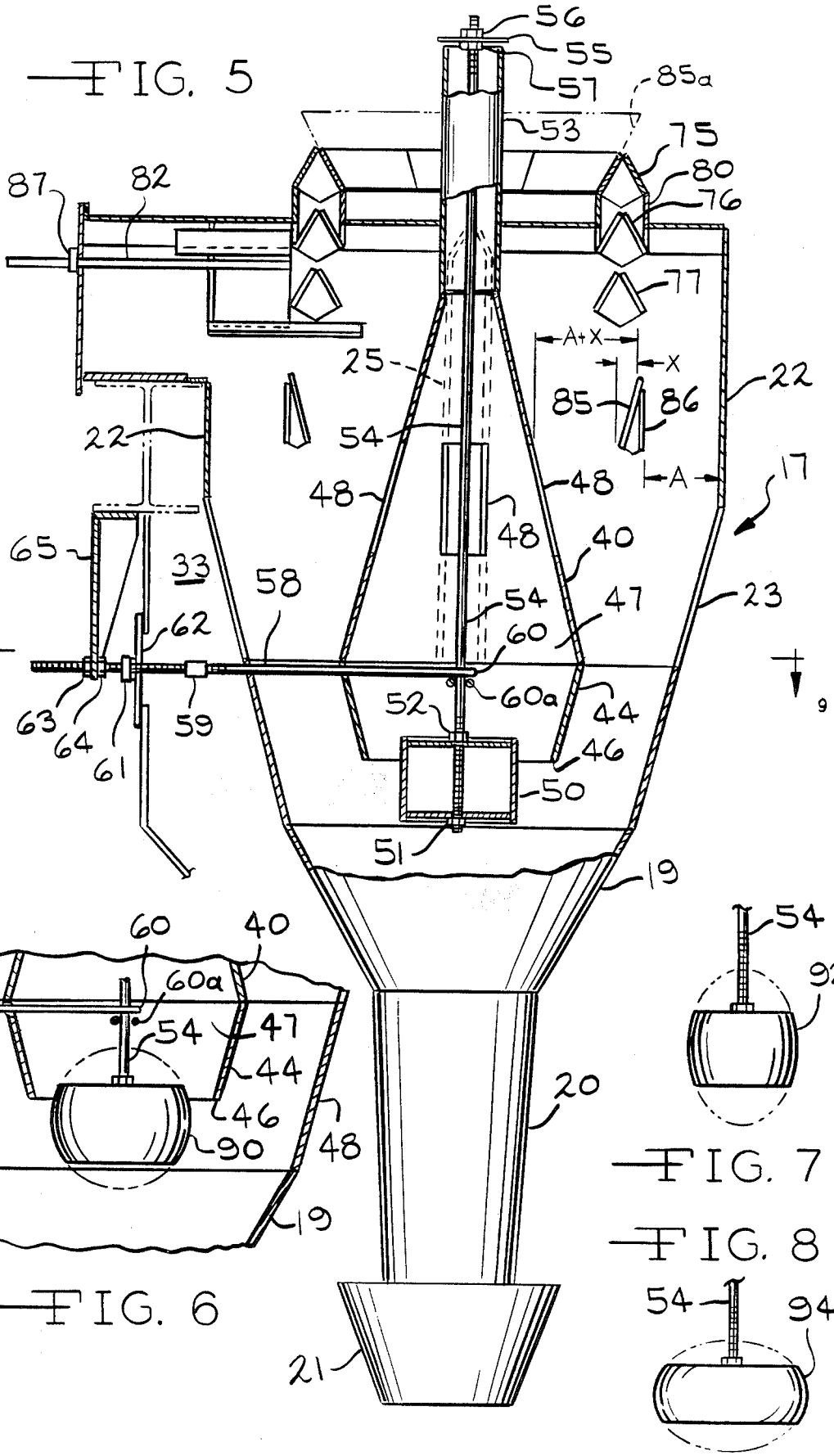
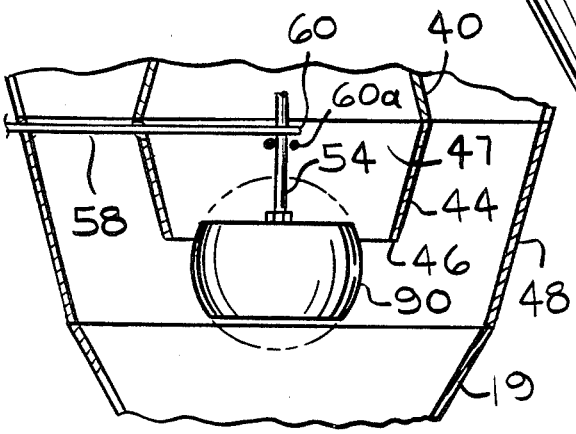
FIG. 6
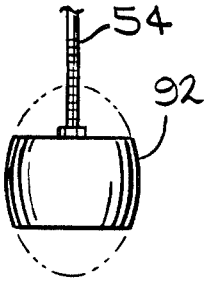
FIG. 7
FIG. 8

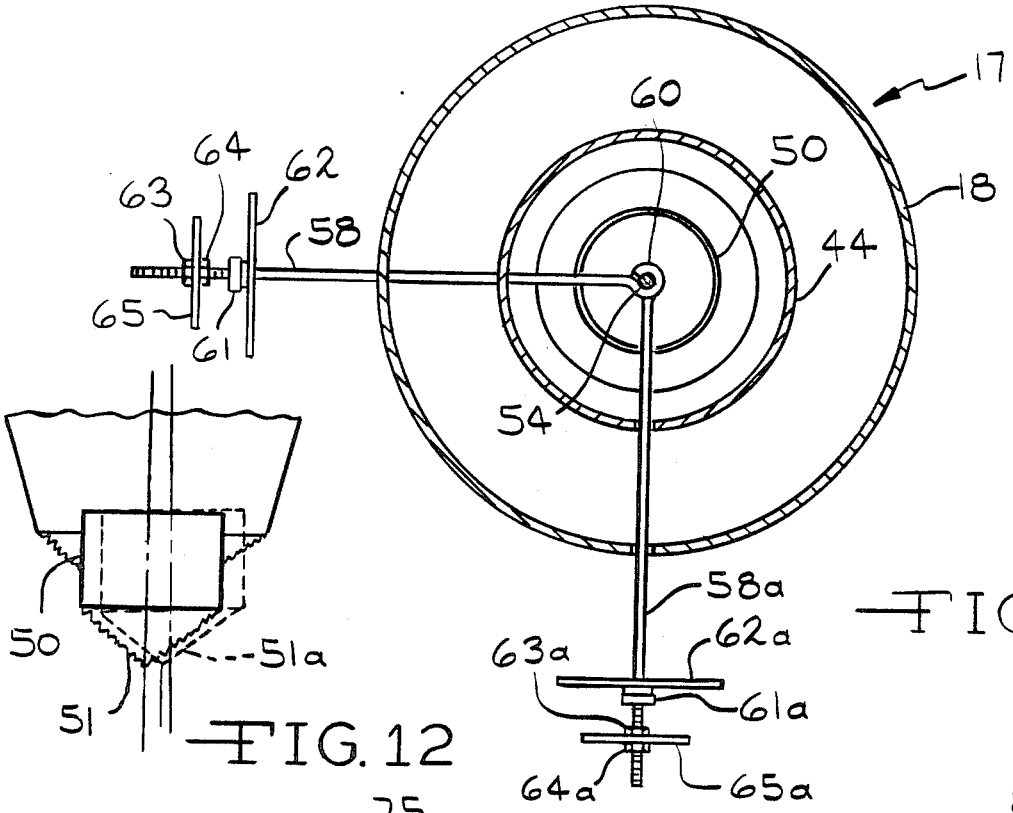
FIG. 9
FIG. 12
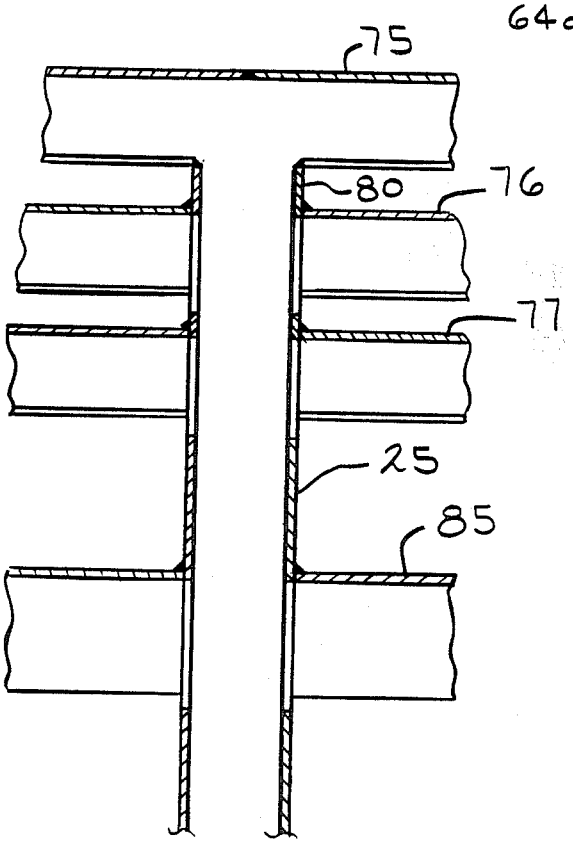
FIG. 10
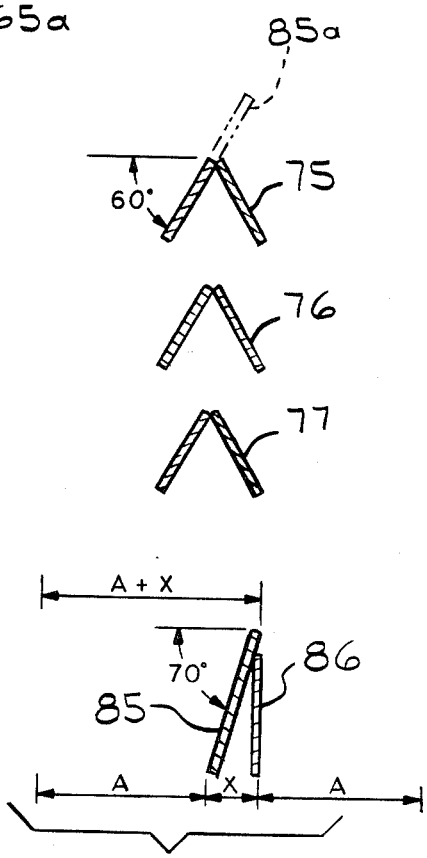
FIG. 11

APPARATUS FOR UNIFORMLY DRAWING AND COOLING PYROPROCESSED PARTICULATE MATERIAL

FIELD OF THE INVENTION

The invention relates to apparatus for cooling of pyroprocessed particulate material such as lime, dead-burned dolomite, lightweight aggregate, Kaolin, and cement clinker or other products herein exemplified by calcined lime pebbles such as are produced from limestone heat-processed in a kiln. The term particles as used herein includes large and small pieces, pebbles, granules, broken solids, fragments, clinkers, etc. By way of example, lime particles processed in the apparatus of the invention herein described may range in size from dust less than 60 mesh to over 2 inches in size and to much larger sized particles or agglomerates and kiln coating rejected from the cooler by means of grates.

Limestone is typically calcined in a kiln, such as a generally horizontal but slightly inclined rotary kiln, heated by one or more burners which subject the charge to flame temperatures in the order of 2800° F. The heated lime exited from the kiln can be force cooled in a cooling bed such as in a shaft type cooler having a generally vertical cooling bed above a hopper or hoppers through which cooling air is passed upwardly under pressure in counterflow relation to the generally downward mass flow of particles in the bed. The temperature of the lime is reduced to a level which permits subsequent conveying and storage as well as shipment of the material.

PRIOR ART

Cooling of heated pieces of lime and other materials has been accomplished successfully in shaft type coolers such as are disclosed in my U.S. Pat. Nos. 3,578,297, 3,721,021, 3,731,398 and 4,123,850 as well as earlier U.S. Pat. Nos. 2,858,123, 2,901,837 and 2,970,828. These coolers are all within the classification of shaft type coolers wherein material is received continuously in a bed directly from a kiln and then is moved gradually downwardly to the cooler exit as cooling air is passed upwardly therethrough to cool the material. The material being cooled resides in the bed for a period typically in the order of ¾ to 1½ hours to provide the necessary time for heat transfer from the particulate matter to air passing up therethrough. The cooling air is introduced under pressure into the downwardly moving mass of particles from a lower region and is caused to flow in counterflow relation upwardly through the mass. The heated air exiting from the upper region of the bed is used in the system as preheated air for combustion. In some cases, a portion of the preheated air is also used to dry pulverized coal used as fuel for the system.

THE PROBLEM

Such prior art cooler structures include in combination one or more adjacent hoppers, usually a cluster of four, in the lower portion of the cooler within the boundaries of a square or rectangular refractory lined upper shaft portion forming a cooling chamber which extends to a plenum-like firing hood at the discharge end of the kiln from which pyroprocessed material is exited and introduced toward the center of the cooling chamber. The material forms a bed in the cooler from which material is removed in cooled condition from the discharge end of the hoppers.

The bed typically has a range of sizes of particles from course to fine and their natural tendency to segregate within the bed influences the rate of both material and air flow in the bed. Finer particles segregate in the central highest surface region of the bed and have a greater resistance to air flow, with course particles becoming distributed peripherally thereabout and at lower levels with less resistance to air flow. In each of the hoppers there is a significant difference in the particle sizes on opposed sides of the hoppers with the finer sized particle masses exiting from the hoppers more readily than the masses with coarser sizes because of the need for all particles to adjust to hopper areas that are progressively less as the discharge standpipe is approached resulting in non-uniform draw rates and air product (A/P) ratios. The differences in both the elevations and permeabilities of the central vs the peripheral zones also result in differences in air flows and A/P ratios. Existing hopper designs do not address these problems having no control over air admission to critical zones of each hopper, nor over material flow rates within each hopper.

Thus, uniformity of draw and uniformity of flow of air through particulate material within shaft type coolers of the prior art are adversely influenced by the hopper design and by the natural tendencies of the contained material to segregate according to size with non-uniform bed surface and depth.

Existing shaft type coolers have been typically oversized at a significant cost in an unsuccessful effort to overcome these problems in achieving a uniform distribution of air through the particle mass in the cooler. Such cooler designs perform to an acceptable degree as long as the total air/product (A/P) ratio can be high enough so that a significant amount of product does not pass through the cooler with an A/P less than one. If, however, a significant amount of product does pass through the cooler with an A/P ratio less than one, that portion will be discharged at an excessive temperature. The temperature of such product may range up to 1200° F. depending on how low the A/P ratio is, even though the balance of the product may be at acceptable temperatures such, for example, as within 50° F. of ambient.

Tests of existing shaft type coolers have shown, for example, that in range of 25% of the total cooler cross-section would draw down at an average rate at least twice that of the remaining 75%. The resultant imbalance in A/P ratio from this factor is such that if the total average A/P is less than 1.75/1, the 25% that is drawing at the faster rate must be at A/P less than 1/1. This results in high discharge temperatures and lowered recuperative efficiency, unless relative air flows can be made to compensate, and this has been found to be difficult or impossible to do. As the total average A/P ratio is forced lower to satisfy more modern and efficient kiln system requirements it is mandatory that the imbalance in draw be minimized. By way of example, at a total average of 1.3/1 A/P ratio, the maximum acceptable imbalance in 25% of the bed could be only 1.4 times the draw rate of the other 75% of the bed.

As present industry trends toward use of more efficient preheater kilns, kiln insulation, internal heat exchangers and proportionately larger coal mills requiring a greater amount of ambient air, the amount of air available for recuperative cooling is significantly reduced. It is highly desirable therefore that the cooler design be such that it promotes uniformity of flow of both air and product. The lower the amount of air available, the more important it becomes that the cooler can operate effectively at low A/P ratios.

A summation of the factors now adversely affecting achievement of uniform A/P ratios are:

1. Variations in bed depth and consequent variations in air flow across the cooler bed surface from time to time and in different areas at the same moment caused by the initial introduction of product to one or a few local areas in contrast to distribution uniformly across the entire surface of the bed. Variations in depth are also caused by changes in kiln speed, random introduction of obstructions to flow of product to the cooler such as accumulated kiln coating on the grates above the bed, failure to maintain a cooler discharge rate the same as the product input rate from the kiln and introduction of product within a concentrated or confined zone resulting in a typically peaked bed surface;

2. Variations in bed permeability and consequent variations in air flow from time to time and at the same moment caused by segregation within the bed according to particle size as particles are introduced to the cooler bed surface within one or a few localized, zones and variations in the screen analyses of the kiln product;

3. Hopper designs inherently subject to asymetric draw due to variations in particle size around the perimeter of the hopper discharge. These variations are caused by segregation within the bed as discussed in item 2 above;

4. Lack of control over air admission to critical zones and

5. Introduction of air at the hopper perimeter rather than in the center of zones of highest draw rate.

It is thus a basic object of the present invention to provide a shaft type cooler which will promote equalization of air/product ratios throughout the cross section at each level of the bed of particles therein. In this regard it is desired that the cooler permit recuperation of approximately 95% or more of the sensible heat in the product discharged from a kiln while cooling the product to temperatures within 50° of ambient. It is desired more specifically that air be blown through the cooler with a relatively uniform A/P ratio in the range of 1.4/1 or less, which is substantially lower than has been heretofore successfully possible in shaft type coolers.

It is another basic objective of the present invention to to provide a shaft type cooler design in which the adverse effects of the segregation tendencies of particles is minimized and in which each unit mass of particulate product will be contacted, more nearly than heretofore possible, by the same proportionate amount of cooling air as all other unit masses of product discharged from the cooler.

Additional objectives include economy of size, reduced blowback of fines and lower power requirements all of which are possible with the design of the present invention. The product exiting from the kiln is cooled from a temperature generally in a range of from 1500° F. to 2400° F. to a temperature low enough to permit its further processing such as transporting the material on a rubber conveyor belt, or oiling when the material is dead burned dolomite, or packing in paper bags. In so cooling the material it is important to recuperate as much of the sensible heat in the product as possible, and to return this heat to the process in the form of preheated air for combustion or for a coal pulverizer if used. Such recuperated heat has an effect on total fuel consumption that may range, in the case of lime, up to three or more times the apparent value, so that the recuperative efficiency of the cooler thus has a significant affect on product fuel cost for all products cooled, and a particularly significant affect on the fuel cost of burning lime. Another basic objective is to accomplish the cooling and recuperation of heat using only the limited amount of air that can be reutilized in the combustion process. It is further important that the cooler design allow air to be passed through the bed with a minimum blow back of fines and an economically acceptable level of power consumption.

BRIEF DESCRIPTION OF THE INVENTION

The invention lies in a unique particle cooler arrangement having a hopper or a cluster of hoppers with associated material and air flow directing means capable of imparting uniform cooling to each incremental portion of the mass flowing therethrough regardless of variations in bed depth, permeability or segregation according to particle size. Each hopper is a composite angled generally conical hopper provided on its interior with a centrally positioned outwardly flaring inverted cone section having mated with its bottom edge a lower inwardly frustoconical section. The inverted cone acts to force the particles to draw down outwardly toward the sides of the hopper rather than otherwise allow them to flow in their natural path through the center of the bed while the frustoconical section assists. Partitions are provided between the frustoconical section and the adjacent lower portion of the hopper to further reduce tendencies toward differences in the flow rates of different sized particles. In addition, a movable flow regulating member is provided generally in the region of the open bottom portion of the frustoconical section to regulate and balance flow rates to compensate for variations in flow rates due to particle size and to balance material flow with air flow regardless of differences in bed permeability or depth, or still remaining differences in draw rates or air flow rates.

Still further, stacked air inlet ports are provided in the upper region of the hoppers in the zone of maxiumum material draw in the cooler. A unique deflector member or ring is also provided under or over the air inlet ports in a location and with an orientation which promotes equal draw rate of product such that the air/product (A/P) ratios are more equally balanced to additionally promote the desired uniformity of mass cooling.

Features of the invention include improvement in the recuperative cooling efficiency and ability of the cooler to operate successfully on lower air/product ratios. It promotes more equal dissipation of heat from each incremental portion of the mass and lowers the temperature of the mass of particles exiting from the cooler. The lower A/P ratios result in lower total air requirement and exponentially reduces static pressure requirements. This significantly reduces fan power requirements as well as the air velocities and amount of air-borne fines that might be blown back into the kiln.

Other objects and features which are believed to be characteristic of my invention are set forth with particularity in the appended claims. My invention, however, both in organization and manner of construction, together with further objects and features thereof may be best understood with reference to the following description taken in connection with the accompanying drawings.

THE DRAWINGS

FIG. 5 is a partially broken away cross-sectional view of a hopper of FIG. 1 showing dampers, air ducts, inverted cones, frustoconical sections, hoppers, flow deflector plates and adjustable cylindrical flow regulating assembly;

FIG. 6 shows a broken away cross-sectional view of a portion of FIG. 5 illustrating an alternate form for the cylindrical flow regulating mechanism of FIG. 5;

FIGS. 7 and 8 illustrate still other forms for the flow regulating mechanism of FIG. 5;

FIG. 9 is a cross-sectional plan view of the adjustable flow regulating assembly of FIG. 5 as taken on line 9—9 showing the adjustment rods for positioning the flow regulator;

FIG. 10 is a partially broken away cross-sectional view of an air duct and air inlet channels of FIG. 3 as taken on line 10—10; and FIG. 11 is a cross-sectional end view of a portion of the air inlet assembly and deflector ring of FIG. 10 as taken on line 11—11 of FIG. 3.

FIG. 12 is a schematic illustration of the flow regulating body of FIG. 5 positioned in a central location as well as in a shifted position shown in dashed lines.

DESCRIPTION OF THE INVENTION

Figure 1:
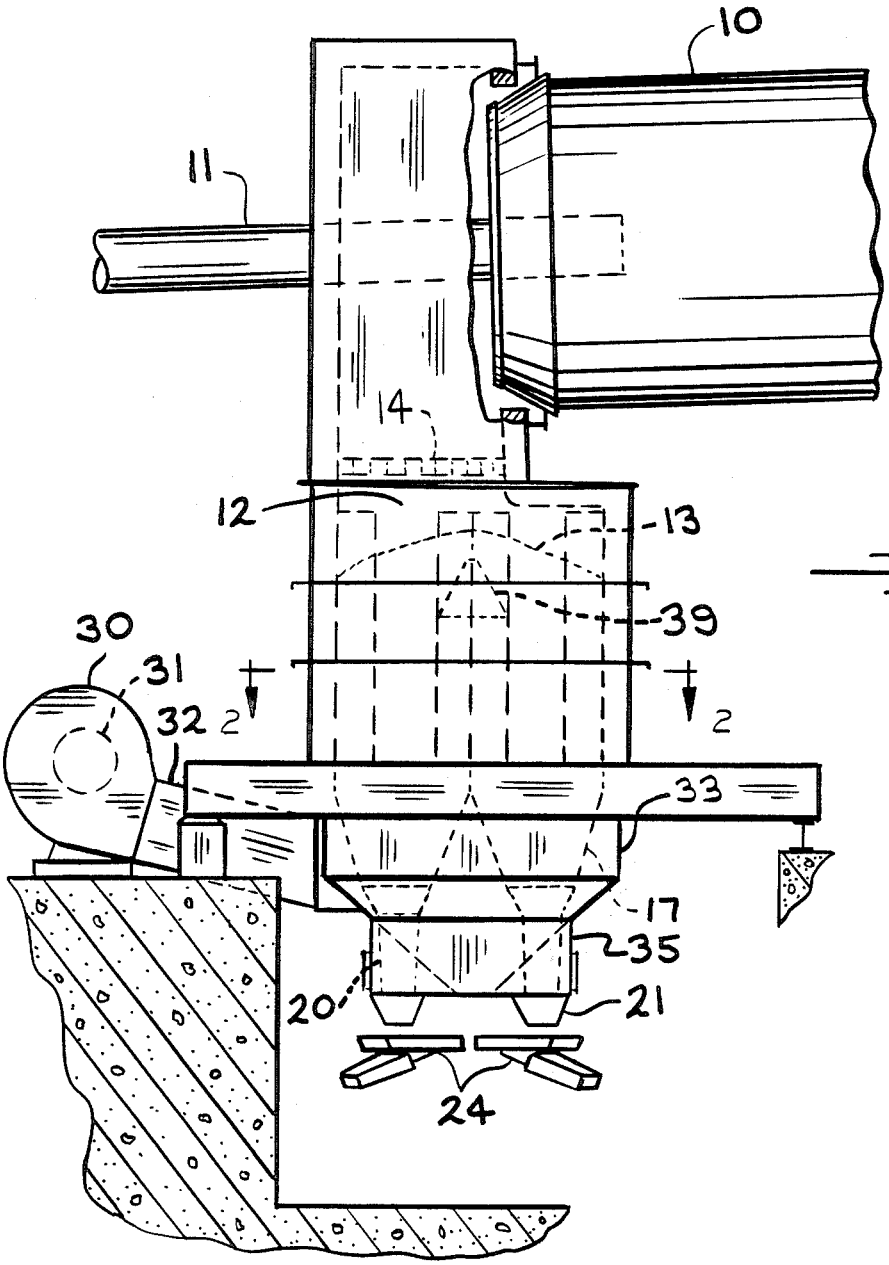
FIG. 1 is a side elevational, partially cross-sectional and partially broken away view of the end portion of a kiln in operating association with an underlying shaft type cooler of the present invention.

Referring to the drawings in greater detail, FIG. 1 shows a general arrangement of components of a cooler at the end of a rotary kiln 10 in which limestone or other matter has been calcined or otherwise heat treated. Burner 11 is representative of one or more burners located on the discharge end of the kiln for supply of heat for calcination or other heat treatment of the charge. The kiln 10 is inclined slightly downwardly relative to the horizontal to promote discharge of its processed output by gravity into the cooler chamber 12. Prior to deposition of the product in the cooling bed 13, it is passed through an apertured grate 14 which separates large pieces of kiln coating or foreign matter from the product of acceptable size for treatment in the cooler. The material in the bed 13 moves generally downwardly and continuously into a cluster of four generally conically shaped hoppers 17 located in adjacent relation about the center of the bed as illustrated more clearly in the plan view of FIG. 2. The material flowing through the hoppers 17 is cooled by air supplied under pressure to the bed 13 by way of a plenum 33 connected by a duct 32 to a fan 30 having a main metering inlet duct 31 open to the atmosphere. Cooled material of the bed is discharged from the hoppers 17 through exit air lock standpipes 20 onto a feeder such as electro vibrator feeders 24, which transfer the material to conveyor belts or to other processing stages.

Figure 2:
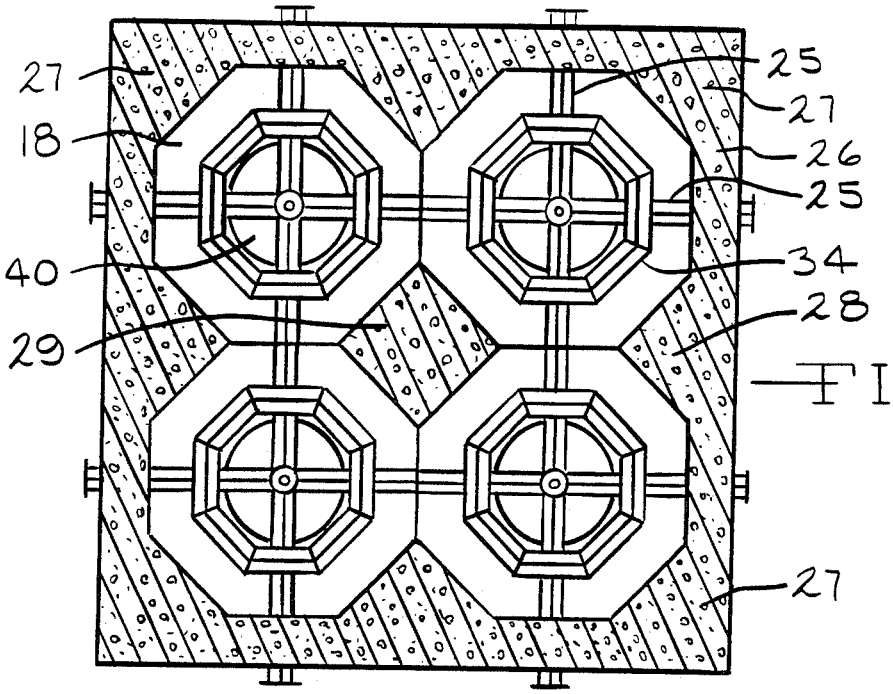
FIG. 2 is a cross-sectional plan view taken on line 2—2 of FIG. 1.

FIG. 2 illustrates the special octagonal shaping of the vertical refractory walls of the cooler shaft or chamber with a partially octagon cross-sectional wall portion about the top of each hopper. Each partial octagon is joined to an adjacent similar wall section, with the overall assembly of such sections being arranged to accommodate a cluster of four adjacent conically shaped hoppers represented in FIG. 1. In contrast to a square cooling chamber, the chamber 12 incorporates vertical faced diagonal corner segments 27 and mid-region segments 28 of isosceles triangular cross-sectional shape, the apex of which project toward the center of the chamber to add to the wall segments which form part of an octagonally shaped cooler shaft or chamber region above and about the top of each conical hopper 17. Thus the cooling chamber 12 presents a partially octagonal shaped wall portion above each hopper. A central refractory segment 29 of square cross-sectional shape diagonally aligned rises up to add to the octagonal wall portion desired above each hopper. The segment 29 fills in the mid-region of corresponding cross-sectional shape formed at the center of the cluster of hoppers 17. Segment 29 extends upward to a peak 39, shown on FIG. 1, which can be made of either metal or refractory material, just under the top center of the bed 13 and acts to direct the particles into regions of the chamber 12 overlying all four hoppers 17.

Air is introduced into the bed 13 residing in the partially octagonal walled cooling chamber sections through an assembly of air ducts 25 leading to ports or channels 34 within the bed. The pattern of the assembly of air channels 34 is octagonally configurated and is aligned in generally concentric relation with the cooler chamber sections and hopper outlet standpipes. The air input channel assemblies 34 are each located at a level generally in the upper region of their respective hoppers 17 in the annulus of greatest draw rate and of sufficient capacity to pass 85% or more of the total air blown into the cooler. They provide the cooling air that flows upward in counterflow relation through particles moving downward through the bed 13.

The hoppers 17, although herein referred to as conical, or generally conical in shape, in fact are made up more specifically of two frustoconical sections of different slopes joined together into a substantially conical form and provided with an outlet below. The dual angled conical hoppers 17 are exemplified herein by a uniform steep walled (75°±5°) upper frustoconical section 18 which joins a lower shallower uniform angled (50°±5°) frustoconical section 19 leading to an exiting standpipe 20. Slot openings 23 represented in FIG. 5 are provided in the side of the upper section 18 for passage of air to ducts 25 to which air is fed under pressure from plenum 33 and the fan 31 for supply to the air input channel assemblies 34.

The steep walled section 18 of each of the hoppers 17 angles upward toward the refractory walls of the chamber 12 where it is arranged, according to the present invention, to merge with the flat internal faces of segments 27, 28 and 29 of the vertical walls of the octagonally shaped cooler chamber. In this respect, the flat faces of the chamber 12 are each mated by one of a series of vertical flat curvalinear scallop shaped segments 22. The scallop segments 22 are of metal welded or otherwise suitably incorporated in the upper marginal region of the hopper and each mates with either a side wall face portion of the partially octagonal shaped cooling chamber 12 or a matching scalloped face of an adjacent hopper in a cluster.

A plan view of the cooling chamber 11 and the cluster of four hoppers 17 as taken on line 2—2 of FIG. 1 is shown in FIG. 2. The refractory walls of the chamber are constructed to provide a partially octagonal configuration in the cooling chamber wall portions above and adjacent to each hopper 17. The octagonal shaped boundry for each hopper is partially completed in outline by the diagonally oriented central square segment 29 and with abutting walls of two adjacent hoppers. Diagonal corner segments 27 and mid-region segments 28 between corners of the refractory walls 26 provide the angular relation for the refractory walls 26 to provide the portion of the octagonal configuration in the outer wall sections about each hopper. The shallow walled portion 19, FIG. 5, leading to the discharge exit of each hopper 17 is surrounded in the plan view by the steep angled upper walled portion 18.

A conical distributor or dispersal cone 40 or what might also be viewed as an inverted cone is provided centrally in or above the steep portion 18 of the hopper 17 to force the draw to proceed down the sides rather than channel through the center. The disposal cone is mated on its under edge by a frustoconical section 44 having a progressively diminishing diameter in its downward direction to match the angle of the wall of the hopper, further channelling the draw of material along the walls of the hopper and toward the hopper exit.

Each hopper is topped by one or a set of air inlet channel ring assembly 34 positioned to supply air directly into the particle bed 13 in the zone of greatest draw of material. By providing air inlets with sufficient capacity to pass 85% or more of the air in this zone, where draw of material is the greatest, the A/P ratio will become more balanced than has been experienced with prior designs which have had less air inlet capacity within the bed and instead relied on outer perimeter inlets for the bulk of cooling air. The air inlet channels can be seen more clearly in FIGS. 3 and 5 in which air is supplied to the set of air inlet rings of assembly 34 through four narrow ducts 25. The air rings of assembly 34 can be formed of segments of longitudinal members such as 60° V-shaped angle members which are oriented with their mid-region up as a top thus providing an underlying air cavity. The segments are joined together end to end to form the octagonal shaped rings.

As an alternate the air inlet rings might also be made of lengths of tubing cut in half which when oriented with their convex side up provide an underlying semicircular cavity. The semicircular cavity in combination with the material sloped down at its angle of repose from both sides of the member below forms a channel for passage of the air within and through the bed. The width of the member and number of rings stacked in the assembly 34 are capable of being designed with a capacity to input the 85% or more of the air required for cooling. The remaining 15% of the total air would be introduced from under the frustoconical section 44 or from an optional central air port not shown. Each ring is provided an air connection with the ducts 25 at each of their cross-over regions 71*a*, 71*b*, 71*c*, and 71*d*.

The air channel rings are assembled close together to provide the concentrated input of air desired. The spacing between the channels is sufficient that the particulate material flowing about both sides of the channel will at its natural angle of repose meet near the peak of the next underlying channel, yet they are placed as close as possible to each other but not so close that the top of each underlying channel would interfere with the void in the material naturally formed under the given channel. This is accomplished by positioning the top of the underlying channel near the junctions of the angles of repose of the material flowing from both sides of the overlying channel.

Figure 3:
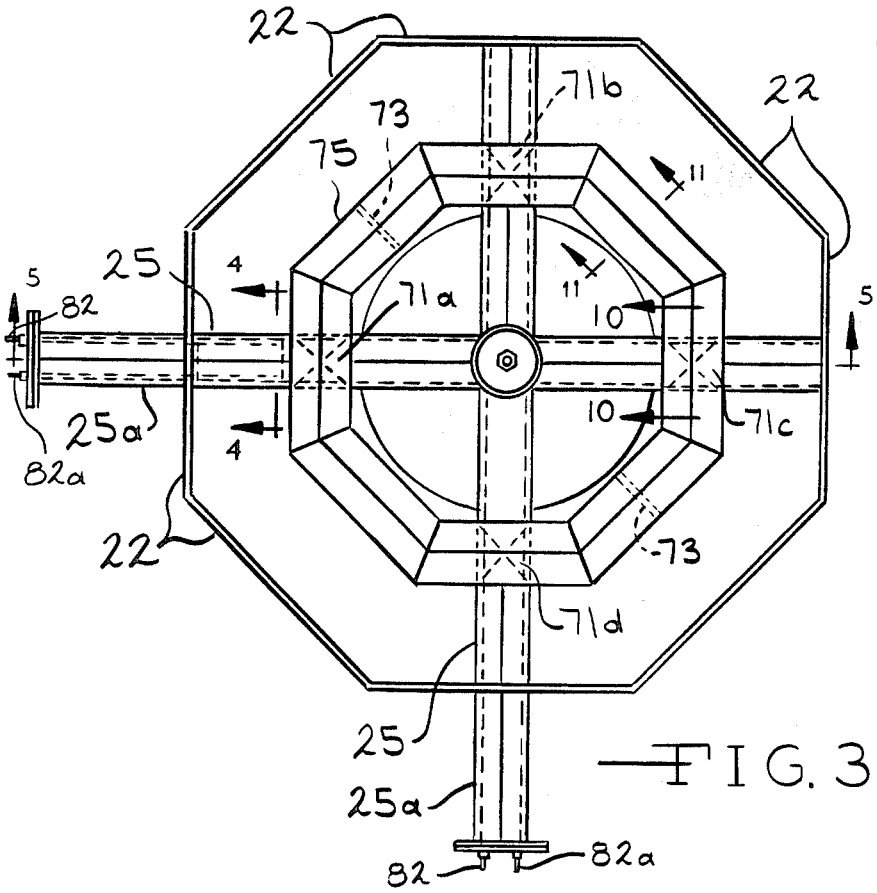
FIG. 3 is an enlarged plan view of an air supply subassembly for the cooler of FIG. 2 showing air inlet channels and supply ducts therefor and isolation dampers, as well as the octagonal sides of the hopper.

The air inlet ring assembly 34 is spaced an adequate distance from the walls of the hopper and the cone section that random oversize coating or refractory brick bats can pass through. The top ring 75 is mounted above the top of the ducts by vertical support members 80 at each of the cross-over regions while the rings 76 and 77 are supported by being fastened to the ducts 25 such as by being welded thereto. Air is introduced into the ring 75 at the cross-over regions 71*a*, 71*b*, 71*c* and 71*d*, FIG. 3, and conveyed therefrom about the air ring. As can be seen in FIGS. 5 and 10, the ring 75 of FIG. 3 is representative of the set of three similar rings 75, 76 and 77 of assembly 34 with ring 75 being the topmost ring.

The air ring assembly and duct arrangement lends itself to a space compactness within which a major portion of the cooling air requirement of the cooler can be introduced. This further leads itself to an effective means of control of the overall air flow to the different quadrants of each hopper in contrast to prior coolers in which cooling air is introduced in dispersed locations through louvers located on the inside and outside of the hopper and over a significantly larger vertical displacement distance. Such wide distribution of air inlets made it an extremely complex task to control air flow to the different quadrants of each hopper as herein disclosed. This design uniquely allows supply of 85% or more of the air inlet capacity within a short vertical displacement distance, for example a distance of approximately one foot, and significantly in the center of the zone of maximum draw of the cooler. The compact spacing also permits cooling of finer sized material such as dead-burned dolomite, light weight aggregate, or ⅜" lime sizes. Such fine sized material presents such a high pressure per foot of height on the air inlet system that the total bed depth above the air inlet louvers is limited for example to about three feet. Except for such compactness as is made possible by the present air inlet arrangement, such fine materials could not be cooled in a shaft type cooler at the unit rates possible with the present invention.

Figure 4:
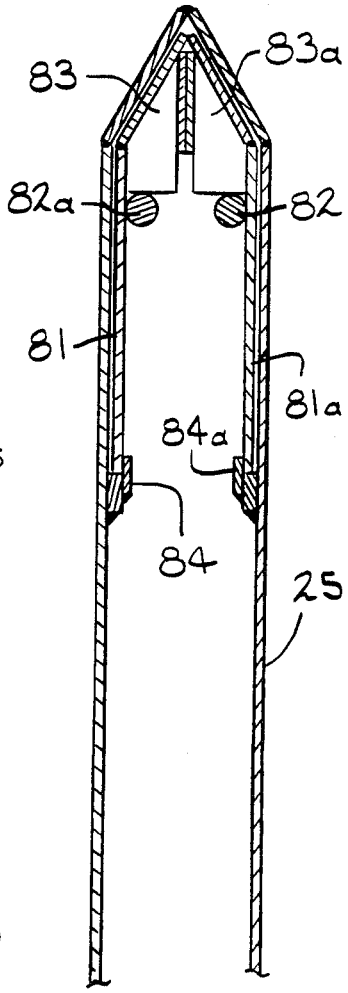
FIG. 4 is an enlarged cross-sectional view of a portion of an air duct of FIG. 3 as taken on line 4—4 and showing two independently adjustable isolation dampers.

Control of the air supply to different zones of the hopper allows selective supply of more or less air to different zones dependent upon demands of bed height, permeability and relative draw rates. FIG. 4 is a cross-sectional view of duct 25 taken on line 4—4 of FIG. 3 which illustrates a damper arrangement for the ducts by which such control is made possible. Two separate damper shutter plates 81 and 81*a* on opposite sides of the entry to the rings 75, 76 and 77 are slidably positionable over openings in the upper side portions of the duct and movable by damper control rods 82 and 82*a* respectively. Damper shutter plates 81 and 81*a* are mounted in support brackets 84 and 84*a* fixed to the side walls of the ducts. The top of each of the damper shutter plates 81 and 81*a* have extensions which angle upwardly to a peak and then downwardly about a bracing member 83 and 83*a* respectively. Control rods 82 and 82*a* are secured to the damper shutter plates 81 and 81*a* respectively such as by welding them in aligned relation along the upper portion of the shutter plates just under the bracing members 83 and 83*a* respectively.

The control rods 82 and 82*a* extend outwardly from duct extensions 25*a* associated with each of the ducts 25 to provide access for ready adjustment of the shutter plates 81 and 81*a* exteriorly of the ducts. Each rod is provided with an air seal 87 and an adjustment means to permit sliding of the damper shutter plates 81 and 81*a* independently to control the amount of air flowing from each side of the inlet duct into the channel rings 75, 76 and 77. Particulate material in the bed 13 flows over air inlet rings 75, 76 and 77. Each of the rings provides a louver formed by a combination of the ring and the angle of repose of the particles as they are drawn down through the cooler. Air flows from under each ring into the particulate matter in the regions of material directly thereunder. Since the air is supplied to the rings through the damper plate openings, the amount of air in each ring is set by the position of the dampers 81 and 81*a* over such openings. Four sets of dampers could be used at each of the crossover regions 71*a*, 71*b*, 71*c* and 71*d* but relative permeability and bed depth typical for most installations require dampers only in the outer quadrants fed at 71*a* and 71*d*. Additionally, plates 73 blanking off the flow of air under the rings from 71*b* and 71*c* towards 71*a* and 71*d* may be installed as shown by dashed lines in FIG. 3. This precludes significant quantities of air flow under the ring from an undampered quadrant to a dampered quadrant.

Another unique feature of the compact distribution controlled air inlet arrangement is that the more nearly the major amount of cooling air is introduced at a given elevation, assuming a uniform distribution of the air, the better is the theoretical heat transfer capability of the cooler.

A deflector ring 85 which provides a particle flow deflecting surface is located below the stack of air inlet rings 75, 76 and 77 between the outer wall of the hopper and the conical section or alternatively, above the top ring 75 as shown in phantom lines 85*a*. It is generally symmetrical in shape to that of the hopper entry such as an octagon shape. The plate can have a range of dimensions and orientations determined by design and trial and error testing. By way of example it may be 4" wide and oriented 75°±5° to the horizontal. A 75° angled plate 6" wide for example, will provide a 1.6" deflection region, while a 9" width plate in plan will provide a 2.3" wide region of influence. The deflector ring increases the area that must be drawn on one side of the ring from an already established area below the ring. This causes a proportionate decrease in the rate of drawn above the ring because the rate of drawn below the ring must now influence a greater area than existed before installation of the ring. As shown in FIG. 5 the distance between the bottom edge of the inclined plate and the inverted cone is generally equal to the distance between the top edge of the deflector and the outer vertical wall portion of the hopper. However, the angle and width of plate is selected by trial and error and past knowledge of flow characteristics to equalize draw rates within the hopper and thus effect the uniformity of temperature desired.

The deflector ring 85 as shown with greatest clarity in FIG. 11 is secured to a support ring member 86 which in cross-section has a vertical alignment and is located under the deflector plate ring 85 where it guides the flow on the hopper wall side of the deflector member 86 in its straight downward path. The flow deflector ring 85, can be in the form of a single ring of a series of plate segments. As segments it can be positioned under selected ones or all the air inlet louvers or rings 34 to influence the rate of descent of product for a balanced temperature across the hopper. The deflector may be optionally ventilated for strength against elevated temperatures such as may be experienced under transitory conditions by arranging for supply of air from the ducts at the duct cross-over regions 71*a*, 71*b*, 71*c* and 71*d* in a manner similar to supply of air to the rings of assembly 34. It may be a circular ring as represented, or oval, or an asymmetrical ring as found most advantageous for specific hopper designs. In prior art arrangements design practices called for installation of baffles in zones of highest draw in an unsuccessful effort to slow the draw in these zones. Such installations failed because they only introduce a transitory change in flow in the vicinity of flow of the baffles without changing flow rates above the baffles and did not recognize the effect of using members with a single slope to draw from a larger area above such members.

FIG. 5 shows the general overall arrangement of components in the cooler hopper of the invention wherein the hopper 17 has an upper steep sloped frustoconical section 18 which provides uniform steepness for the particulate matter in the hopper down to a shallower sloped frustoconical section 19 leading to a standpipe 20. The material flowing downwardly in the hopper is thus presented a uniform angled outer wall at each cross-sectional level of the assembly down to the exit spout 21 from which the material flows to the vibrating feeders 24 below.

The converging wall 18 of the hopper and the diverging wall of the dispersal cone 40 provide, in a sense, an annular funnel for the bed of material contained in the hopper. That is, the material is drawn inwardly by wall 18 and is forced outwardly by the conical distributor 40. The angle of the sides of the inverted cone are the same as the angle of the upper part of the hopper, typically 75°±. The height of the cone is a function of the largest diameter of the hopper. The diameter of the lowest edge of the inverted cone is typically 50% of the maximum diameter of the hopper. The spacing between the bottom edge of the cone and the adjacent hopper wall is large enough to allow passage of the largest pieces of material which are to pass through the unit. This is a spacing of approximately 10" which has been found adequate to handle sporodically experienced brick bats or large coating accumulations which may occasionally bypass the grate. The 50% diameter and ten inch dimension also serve to determine the elevation of the assembly in the hopper.

The underlying frustoconical section 44 mated to the bottom of the dispersal cone 40 guides the draw further along the lower shallow hopper wall. The wall of the lower frustoconical section 44 is generally parallel to the adjacent wall of the hopper and forms an annular inclined particle flow passageway which acts to keep the particle flow along the outerwall of the hopper.

The frustoconical section 44 has an inside opening 47 accessible at its bottom edge 46 which a shown in FIG. 5 terminates above the shallow wall section 19 of the hopper but in some cases may extend into the section 19. The interior of both the dispersal cone 40 and its underlying section 44 are hollow and supplied with cooling air through slots 48 which provide a connection to the air ducts 25. The hollow interior 47 beside supplying a portion of the air emitted to the bed 13, also provides space for support of a flow regulator device in the form of a body of revolution in the region of the lower edge of the frustoconical section 44 and extending therebelow to a region above the discharge opening to the standpipe 20. By making the flow regulator body adjustable in position in a substantially horizontal plane, the pattern of draw of material in any quadrant or segment about the center line of the hopper can be modified as desired to balance air/product ratios.

The body of the regulator device may have any of a number of shapes which are represented in FIG. 5 by a body of revolution in the form of a cylindrical body 50. It is located generally in the region of the lower perimeteral edge 46 of the section 44 which defines an entry to the opening 47. The body is arranged to be horizontally positionable in any location within the region under the section 44 which will provide the flow distribution desired for uniform cooling of particles exiting from the hopper. The diameter of the body is as large as possible within the bounds defined by the edge 46 of the frustoconical section while providing enough space for significant movement of the regulator, typically 4" to one side or the other in all directions. To provide the desired adjustability, the body is hung at its selected level on a suspension rod 54 which is supported at a fulcrum at the top of a mounting column 53 by a support washer 55 and nuts 56 and 57. The fulcrum is as high as possible to minimize differentials in height of the regulator caused by its length and arc of movement. Once the height of the regulator body is selectively fixed, only its horizontal positon is required to be adjusted.

An alternate, arrangement is to support the regulator body 50 on one or more generally horizontal adjustment rods extending at 90° to each other to the center of the cooler in support relation with the regulator body 50. Adjustment in position of the regulator body 50 can then be accomplished by screws associated with the rods. As a conceptual extension of both arrangements for adjusting the position of the body 50, remote controlled power cylinders can be used to position the regulator body.

The suspended distribution regulator 50 shown can be moved laterally off the vertical center line of the hopper within the bounds set by section 44 by two 90° aligned longitudinally adjustable rods 58 and **58*a* which have externally accessable adjustment ends and opposite interiorly located eyelet ends 60 and 60*a* respectively, each of which freely surround the rod 54 at a location above the regulator 50 generally at a level near the top of the frustoconical section 44. In other words, two adjustment rods aligned at 90° to each other extend to the suspension rod 54, and allow horizontal relocation of the regulator 50 to any position desired within the bounds of the opening defined by the edge 46 of section 44. Each of the adjustment rods has a coupling 59 to permit extension to the outside of the plenum 33. FIG. 9 illustrates in plan view the right angularly aligned rods 58 and 58*a* as taken on line 9—9 of FIG. 5. Rod 58 extends to the eyelet 60 which freely surrounds the regulator suspension rod 54. Eyelet 60 is above a similar eyelet 60*a* provided by the right angular rod 58*a*. Both rods extend through plenum cover plates 62 and 62*a*, respectively, and are provided with air sealing glands 61 and 61*a*, respectively, through which the adjustment rods extend for locked adjustment on support brackets 65 and 65*a*, respectively, by adjusting and locking nuts 63 and 64, and 63*a* and 64*a***, respectively.

The distribution regulator 50 extends below the edge 46 of the section 44 to a level above the opening to the discharge section a distance generally equal to the diameter of the top of the downpipe 20 where it can influence the draw of material in any portion of the cross section of the hopper at the lower edge of the distribution regulator 50. If the material flow rate is excessive on one side of the regulator relative to an opposite side, as sensed by measuring the temperature of the hopper wall or of the discharge cone 21, the regulator can be moved away from the side of the lesser flow rate to equalize the flows on both sides. More specifically, if the flow rate in any position is such that the material is hotter on one side than the other, movement of the regulator in the direction of the hot material side will decrease the rate of flow on that side to attain a balance of temperatures of material on opposite sides of the regulator. The adjustments can be made manually based upon temperature of the material in the hopper in different quadrants as determined by feel or by readings of contact pyrometers installed about the hopper wall or the wall of the discharge cone. In the latter instance, automatic adjustments can be made by use of the reading for power operation of the adjusting rods 58 and **58*a***.

FIGS. 6, 7 and 8 illustrate possible alternate shapes which will also fulfill the desired regulating function of the invention. FIG. 6 illustrates a regulator 90 formed of a horizontal segment of a spherical body having its top and bottom removed to leave a body having a flat top and bottom with rounded sides. FIG. 7 illustrates a somewhat like-type horizontal segment of another body of revolution corresponding to a segment of an ellipsoidal body having its longitudinal access co-linear with the suspension rod 54. Similarly, a horizontal segment of a pear-shaped or egg-shaped body may be selected to present more complex surfaces of a body of revolution for different patterns of flow upon movement of the regulator to different positions within the hopper.

The flow regulator is, in a sense, a displacing device positionable to increase or decrease the amount of material moved in any given portion of the cross-section of the hopper as material flows from about the bottom edge 46 of the inverted frustoconical section 44 and past the regulator body 50. A void or absence of material is formed within the particle bed immediately under the body 50 generally shaped like a cone as shown in FIG. 12 with its apex 51 on the centerline of the body 50 and extending downward due to material flow downward and around all sides of the regulator body 50. Upon movement of the flow regulating body 50 from its position of vertical alignment of the suspension rod 54, a new apex **51*a* as shown in dashed lines is formed in the void under the device since the apex does not move entirely with the centerline of the body 50** but is positioned somewhat in the direction opposite to the direction of movement of the body and the effect on desired flow change is somewhat reduced. A void is presented whether the regulator is a cylinder, a sphere, a horizontally segmented sphere or any of a number of other shapes.

When the regulator is a segmented sphere or sphere, however, as shown in FIG. 6, the apex of the conical void thereunder can be maintained generally in the same location under the segmented sphere or sphere within the limits of lateral movement of the regulator body. The curvalinear side surfaces of the spherical body segment compensate for the lateral position shift in comparison to a corresponding shift of a cylindrical body and accordingly eliminate the countermovement of the apex described for a cylindrical shape.

It has been found that the flow regulator can change the relative draw rates in the order of 40% in opposed quadrants or sections of the cooler. The size of the regulator and its surrounding marginal space determine the magnitude of the changes in draw rates which are possible. In addition to providing clearance within the opening for a degree of desired movement of the regulator, adequate clearance must also be provided under the inverted frustoconical distributor and above the discharge exit to avoid jamming or hangups from random large size particles and extraneous matter such as a refractory brick falling out of the kiln and getting through the usual underlying cooler grate. Thus the provision of theoretically desireable dimensions are limited by the practicality of required clearances.

The regulator body 50 must be sufficiently large in diameter to provide a flow control and yet small enough within the frustroconical section opening 46 to be adjustable. If it is inadequately sized, it will not provide significant control of flow. If it is too large, it will not be movable for adjustment in the opening to provide the flow regulation desired. As an example of an operable size, if the frustoconical opening diameter is 24" a regulator body in the form of a cylinder may have a diameter of 17" or approximately 70% of the opening. What is sought in fixing the size of the regulator is the ability to effect a significant change in draw rate in any quadrant of the cross-section of the hopper vs. an opposed quadrant, for example up to a 40% change.

The bottom of the regulator body is preferrably suspended close to but a distance above the opening to the discharge section approximately equal to the diameter of the exit opening.

By provision of the flow rate regulator 50 A/P ratios can be more nearly balanced regardless of the adverse effects of particle size segregation on draw rates and bed permeability, and the imbalance in air flows caused by differences in bed depth or improper hopper designs.

In view of the foregoing, while the invention has been described with regard to the illustrated embodiments, it will be recognized that my invention is not limited specifically to the particular arrangements shown and described, and accordingly, by the appended claims all modifications, adaptations and arrangements thereof are contemplated which fall within the spirit and scope of the invention.

I claim:

1. Apparatus for cooling hot particulate material comprising in combination a kiln from which such material is supplied, a cooling shaft positioned in association with said kiln for continuous receipt and containment of a bed of such hot particulate material, at least one generally conical shaped hopper underlying said cooling shaft for flow therethrough of particulate material of said bed to a lower discharge outlet of the hopper, said hopper comprising a circular uniform angled wall directed toward said outlet, flow dispersing means comprising a conically shaped section having its smallest dimension at the top centrally located in said hopper to cause the downward passage of material in the upper region of said hopper to move radially outward, a frustoconical flow guiding section located in the lower region of said hopper mated with the bottom of said conical section and forming an inclined annular passageway with the adjacent wall of said hopper to receive and guide material flowing below said conical section toward said discharge outlet, and an air supply means in the region of said bed for supply of cooling air under pressure to force said air through said bed, said air supply means comprising an air supply ring on at least one air supply duct connected thereto, said air supply ring being aligned in concentric relation about the central axis of said conically shaped section generally midway in the path of flow of material between said conically shaped section and the wall of said cooler.

2. Apparatus for cooling hot particulate material as set forth in claim 1 in which said air supply ring comprises one of a plurality of such rings vertically stacked concentrically in compact sufficiently close spaced relation to prevent obstructing flow of material therebetween but sufficiently spaced for noninterferring supply of cooling air supplied to a bed of such material in said cooler.

3. Apparatus as set forth in claim 2 in which said rings have a capacity to supply approximately 85% of the total cooling air requirements of said bed.

4. Apparatus as set forth in claim 2 in which each of said air supply rings comprises a given shaped longitudinal length of member having an open air cavity thereunder joined together in ring form.

5. Apparatus as set forth in claim 2 in which at least one duct extends through the wall of said hopper for extension to the central region thereof and connection with each of said plurality of stacked rings, said duct being narrow and having its major dimension in a vertical direction, said duct having air openings on opposite sides thereof directly to the cavity of each of said stacked rings.

6. Apparatus as set forth in claim 5 in which the topmost ring in said stacked rings is connected to said air duct by way of at least one opening in the top of duct at the level of the immediately underlying ring.

7. Apparatus as set forth in claim 5 in which each said side opening to said rings has an associated adjustable damper for adjustable closure thereof for controlled limitation of the amount of air flow therethrough, and adjustment means associated with each said damper externally accessible to said hopper for balance of flow of air to all quadrants of the hopper.

8. Apparatus as set forth in claim 1 including a particle flow deflector plate in the path of flow of particles from said cooling shaft, said plate being adjacently disposed and angularly inclined toward said conically shaped section.

9. Apparatus as set forth in claim 8 in which said flow deflector plate is in the form of a ring disposed in a region below said stacked air supply rings, said deflector ring being of size and being positioned in the flow path of said particulate material in said cone to substantially equalize flow rates above the ring and on opposite sides thereof and to promote cooling of material flowing to said discharge outlet to an acceptable temperature level.

10. Apparatus as set forth in claim 9 in which said deflector ring is positioned in the flow path of said particulate material where the distance between its bottom inner edge and the adjacent wall of said conical section and the distance between its top outer edge and the adjacent wall of said hopper are each of a dimension adequate to allow passage of random oversized pieces in said cooler.

11. Apparatus as set forth in claim 10 in which said distances are each at least 10".

12. Apparatus as set forth in claim 8 in which said flow deflector plate is in the form of a ring disposed in a region above said stacked air supply rings, said deflector ring being of size and being positioned in the flow path of said particulate material in said cone to substantially equalize flow rates above the ring and on opposite sides thereof and to promote cooling of material flowing to said discharge outlet to an acceptable temperature level.

13. Apparatus for cooling hot particulate material comprising in combination a kiln from which such hot particulate material is supplied, a refractory lined cooling shaft positioned in association with said kiln for receipt of and containment of a bed of such hot particulate material, a conical hopper underlying said cooling shaft for flow therethrough of particulate material of said bed to a lower discharge outlet of the hopper, means for forcing cooling air under pressure through material in said bed, said hopper comprising a circular uniform angled wall section, material flow guiding means within said hopper section comprising a centrally located frustoconical section diminishing in cross-sectional dimension toward a lower edge above said outlet to guide the flow of such material along the wall of said uniform angled wall section, a particle flow distribution regulator body lying in space outlined by and extending below the lower edge of said frustoconical section for contact on all sides by material flowing down and around said edge, means for lateral positioning of said regulator body, said regulator body being positionable by said positioning means in said space in a location to balance the flow of particles in said hopper around said regulator for establishment of a minimum of temperature differential of material within the cross-section at each level of the hopper.

14. Apparatus as set forth in claim 13 in which a flow dispersal means comprising a conical shaped section shaped to guide the downward passage of material outwardly toward said hopper wall is mated in overlying relation with said frustoconical section.

15. Apparatus for cooling hot particulate material as set forth in claim 14 in which said regulator body is in the form of a body of revolution with a generally vertical axis.

16. Apparatus as set forth in claim 15 in which said body is cylindrical in shape.

17. Apparatus as set forth in claim 15 in which said body of revolution has arcuate sides.

18. Apparatus as set forth in claim 15 in which said body is a sphere.

19. Apparatus as set forth in claim 15 in which said body is a horizontal segment of a sphere having a relatively flat top and flat bottom and curved sides.

20. Apparatus as set forth in claim 15 including body adjusting means by which said body is adjustable in horizontal position within the space outlined by the lower perimeter of said flow guiding means.

21. Apparatus as set forth in claim 20 in which means is provided for suspension of said body with a fulcrum above said flow guiding means.

22. Apparatus as set forth in claim 21 including body positioning means comprising right angularly oriented generally horizontal members extending from outside said hopper to said body for horizontal positioning of said body within said hopper.

* * * * *